US006745526B1

(12) United States Patent
Autovino

(10) Patent No.: US 6,745,526 B1
(45) Date of Patent: Jun. 8, 2004

(54) FIRE RETARDANT WOODEN DOOR WITH INTUMESCENT MATERIALS

(76) Inventor: Enrico Autovino, 10 S. Inman Ave., Avenel, NJ (US) 07001

( * ) Notice: Subject to any disclaimer, the term of this patent is extended or adjusted under 35 U.S.C. 154(b) by 0 days.

(21) Appl. No.: 10/414,712

(22) Filed: Apr. 16, 2003

(51) Int. Cl.[7] ..... E04C 2/00
(52) U.S. Cl. ..... 52/232; 52/456; 52/656.4
(58) Field of Search ..... 52/232, 455, 456, 52/456.4

(56) References Cited

U.S. PATENT DOCUMENTS

| | | | | | |
|---|---|---|---|---|---|
| 2,549,205 | A | * | 4/1951 | Katz et al. | 52/784.11 |
| 4,104,427 | A | * | 8/1978 | Nolte et al. | 428/68 |
| 4,265,068 | A | * | 5/1981 | Pomroy | 52/456 |
| 4,367,614 | A | * | 1/1983 | Warwick | 52/455 |
| 4,441,296 | A | * | 4/1984 | Grabendike et al. | 52/456 |
| 4,702,054 | A | * | 10/1987 | Turner | 52/455 |
| 4,896,471 | A | * | 1/1990 | Turner | 52/455 |
| 6,434,899 | B1 | * | 8/2002 | Fortin et al. | 52/232 |
| 6,510,807 | B2 | * | 1/2003 | Gottfried | 114/78 |
| 6,643,991 | B1 | * | 11/2003 | Moyes | 52/784.11 |
| 2002/0100404 | A1 | * | 8/2002 | Gottfried | 114/78 |
| 2002/0124497 | A1 | * | 9/2002 | Fortin et al. | 52/232 |

FOREIGN PATENT DOCUMENTS

GB 2 135 373 A * 8/1984

* cited by examiner

*Primary Examiner*—Ramon O. Ramirez
*Assistant Examiner*—Kofi Schulterbrandt

(57) ABSTRACT

A fire retardant wooden door that prevents the spread of fire through the door during a fire. The fire retardant wooden door has at least one door panel connected to stiles and rails by tongue and groove joints, and the tongue and groove joints have intumescent material therein. Each of the tongue and groove joints includes a tongue section having the intumescent material along a distal edge of the tongue section which expands upon exposure to heat or fire to seal the tongue and groove joints in order to prevent the heat or fire from passing through the door during a fire. Each of the tongue sections includes an interior channel extending along the axis of the tongue section, and the interior channel extends into the door panel. The interior channel has the intumescent material embedded therein which expands upon exposure to heat or fire to further seal the tongue and groove joints in order to prevent the heat or fire from passing through the door during a fire.

24 Claims, 7 Drawing Sheets

FIRE RETARDANT WOODEN DOOR WITH INTUMESCENT MATERIALS

FIELD OF INVENTION

The present invention relates to a fire retardant door, and more particularly to a fire retardant wooden door having intumescent materials therein that provides additional fire resistance for preventing the spread of fire through the fire retardant wooden door and door frame.

BACKGROUND OF THE INVENTION

A fire retardant door, often referred to as a "fire door," is installed in homes, commercial buildings, and industrial plants for preventing the passage or spread of fire from one part of the building to another. In the interest of public safety, standards have been set by governmental agencies; and by municipal, county and state building code authorities and insurance companies for the installation and performance of fire doors. The standards require that the fire retardant doors be installed in wall openings and that they pass industry-wide acceptance tests.

Standard test methods for fire door assemblies, such as ASTM E-152, UL 10(b) or NFPA 252, measure the ability of a door assembly to remain in an opening during a fire to retard the passage of the fire and evaluate the fire resistant properties of the door. In conducting such tests, doors are mounted in an opening of a fire proof wall. One side of the door is exposed to a predetermined range of temperatures over a predetermined period of time, followed by the application of a high pressure hose stream that causes the door to erode and provides a thermal shock to the assembly. Doors are given a fire rating based on the duration of the heat exposure of 20 minutes, 30 minutes, 45 minutes, one hour, 1½ hours or three hours. The door assembly receives the fire rating when it remains in the opening for the duration of the fire test and hose stream, within certain limitations of movement and without developing openings through the door either at the core or around the edge material.

Panel doors have a plurality of flat or raised panels that are connected to vertically extending stiles and horizontal rails. While panel doors are often used due to their visually attractive appearance, it is also common that they have poor resistance to fire because air is able to penetrate the door at the edges of the panels where they are connected to the stiles and rails. In turn, the oxygen present in the air seeps through the door at these joints and feeds the fire. To increase their resistance, some panel doors are made with segments of fire resistant material embedded within grooves that have been milled into the edges of the stiles, rails and panels at the seams of those elements. The implementation of the fire resistant material at these locations is usually effective to retard the rate at which the fire can burn through the joints. However, fire is still able to burn through the wooden portions of the door faster than is desired in most instances.

There remains a need for a fire retardant wooden door having intumescent materials strategically embedded within the joints for connecting the panels to the stiles and rails in order to prevent the spread of fire through the door and door frame. Further, the fire retardant wooden door should include supplemental intumescent materials on the perimeter edges of the fire resistant wooden door for preventing the spread of fire through the door and door frame. Additionally, the fire resistant wooden door should have a fire rating of at least 20 minutes.

DESCRIPTION OF THE PRIOR ART

Fire retardant wooden doors, and fire doors of various designs, configurations, structures and materials of construction have been disclosed in the prior art. For example, U.S. Pat. No. 4,441,296 to Grabendike et al. discloses a fire resistant wood door structure designed to pass the requirements of fire codes and testing laboratories. The fire resistant wood door structure includes a door assembly having a support frame assembly with a panel assembly connected to the support frame assembly. The support frame assembly includes top, bottom, side, central and transverse frame members. The panel members include a main body connected through peripheral edges by a double connector assembly. The double connector assembly functions to only remove about ⅓ of the doors' normal 1¾ inch thickness during the burn testing procedure, thus passing the fire resistant testing of 20 minutes. This prior art patent does not disclose or teach the particular door structure of the present invention, nor the use of intumescent material in the tongue and groove joints in order to provide for a fire retardant wooden door that prevents the spread of fire through the door and door frame.

U.S. Pat. No. 4,930,276 to Bawa et al. discloses a fire door window construction. The fire door includes a trim strip having inner and outer members. The inner trim member is of a high density incombustible mineral material or ceramic and is nailed in position to securely and uniformly hold the pane of glass in the door opening. The outer trim member is of a fire retardant particle board and has an exposed wood veneer facing throughout. An intumescent caulking compound is applied between an inner portion of the outer trim member and the pane of glass. This prior art patent does not disclose or teach the particular door structure of an all wooden door of the present invention, nor the use of intumescent material in the tongue and groove joints in order to provide for a fire retardant wooden door that prevents the spread of fire through the door and door frame for at least 20 minutes.

U.S. Pat. No. 5,417,024 to San Paolo discloses a fire resistant panel door. The fire resistant panel door is constructed from panels, stiles, mullion and rails having a core of fire resistant material. The door components are joined together so that the fire resistant material extends substantially continuously from side to side and from top to bottom of the finished door. The fire resistant core of each door panel is recessed within the fire resistant core of the associated rails and stiles to reduce air infiltration through the door which can compromise the door's fire resistance. This prior art patent does not disclose or teach the particular door structure of an all wooden door of the present invention, nor the use of intumescent material in the tongue and groove joints and perimeter edges in order to provide for a fire retardant wooden door that prevents the spread of fire through the door for at least 20 minutes.

U.S. Pat. No. 5,816,017 to Hunt et al. discloses a fire retardant door and exit device for the fire retardant door. The fire retardant door includes a core of fire resistant blocking material being Tectonite™ for providing the door with a fire rating of at least 90 minutes. The fire door uses intumescent material which expands when heated to fill the void in the channel between the channel walls and the vertical extending rods within the latch stile of the door. This prior art patent does not disclose or teach the particular door structure of an all wooden door of the present invention, nor the use of intumescent material in the tongue and groove joints and perimeter edges in order to provide for a fire retardant wooden door that prevents the spread of fire through the door for at least 20 minutes.

U.S. Pat. No. 6,115,976 to Gomez discloses an assembly for sealing a fire resistant door within a door frame during a fire event. The door edge assembly includes a plurality of door edges for receiving an intumescent strip within a slot on each door edge. The intumescent strip is constructed and designed to expand upon reaching a certain reaction temperature when exposed to a fire event or other extreme heat source. This prior art patent does not disclose or teach the particular door structure of an all wooden door of the present invention, nor the use of intumescent material in the tongue and groove joints in order to provide for a fire retardant wooden door that prevents the spread of fire through the door and door frame for at least 20 minutes.

U.S. Pat. Nos. 4,529,742; 6,031,040; and 6,153,674 each disclose the use of intumescent compounds/fire barrier material within door construction to reduce or eliminate the passage of smoke and fire through the door and door frame. These prior art patents do not disclose or teach the particular door structure of an all wooden door of the present invention, nor the use of intumescent material in the tongue and groove joints in order to provide for a fire retardant wooden door that prevents the spread of fire through the door and door frame for at least 20 minutes.

None of the prior art patents teach or disclose the particular door structure of an all wooden door being fire resistant, nor the use of intumescent material in the tongue and groove joints in order to provide for a fire retardant wooden door that prevents the spread of fire through the door and door frame during a fire for at least 20 minutes.

Accordingly, it is an object of the present invention to provide a fire retardant wooden door that prevents the spread of fire through the door and door frame for at least 20 minutes during the fire.

Another object of the present invention is to provide a fire retardant wooden door that has fire resistant material strategically embedded and placed within the tongue and groove joints of the fire resistant door, as well as supplemental fire resistant material placed on the perimeter edges of the fire resistant door for preventing the spread of fire through the door and door frame.

Another object of the present invention is to provide a fire retardant wooden door that has fire resistant material being intumescent material that expands in the presence of fire such that the intumescent material closes and seals the component tongue and groove joints, as well as the perimeter edges of the fire retardant door for preventing the spread of fire through the door and door frame.

Another object of the present invention is to provide a fire retardant wooden door that is used as part of an interior or exterior personal living space or workspace, and being installed within home dwellings, commercial buildings or industrial plants.

Another object of the present invention is to provide a fire retardant wooden door that is aesthetically pleasing having the appearance of natural wood, and has achieved a successful fire rating of at least 20 minutes, and is easily installed in a building.

A further object of the present invention is to provide a fire retardant wooden door that can be mass produced in an automated and economical matter and is readily affordable to the builder or consumer.

SUMMARY OF THE INVENTION

In accordance with the present invention, there is provided a fire retardant wooden door that prevents the spread of fire through the door during a fire. The fire retardant wooden door has at least one door panel connected to stiles and rails by tongue and groove joints, and the tongue and groove joints have intumescent material therein. Each of the tongue and groove joints includes a tongue section having the intumescent material along a distal edge of the tongue section which expands upon exposure to heat or fire to seal the tongue and groove joints in order to prevent the heat or fire from passing through the door during a fire. Each of the tongue sections include an interior channel extending along the axis of the tongue section, and the interior channel extends into the door panel. The interior channel has the intumescent material embedded therein which expands upon exposure to heat or fire to further seal the tongue and groove joints in order to prevent the heat or fire from passing through the door during a fire.

BRIEF DESCRIPTION OF THE DRAWINGS

Further objects, features and advantages of the present invention will become apparent upon the consideration of the following detailed description of the presently-preferred embodiment when taken in conjunction with the accompanying drawings, wherein.

DETAILED DESCRIPTION OF THE PREFERRED AND ALTERNATE EMBODIMENTS

Preferred Embodiment 10

The fire retardant wooden door 10 of the preferred embodiment of the present invention is represented in detail by FIGS. 1 through 6 of the patent drawings. The fire retardant door 10 is used to fireproof an area and to prevent fire from spreading to other areas within a home dwelling, commercial building or industrial plant.

Figure 1:
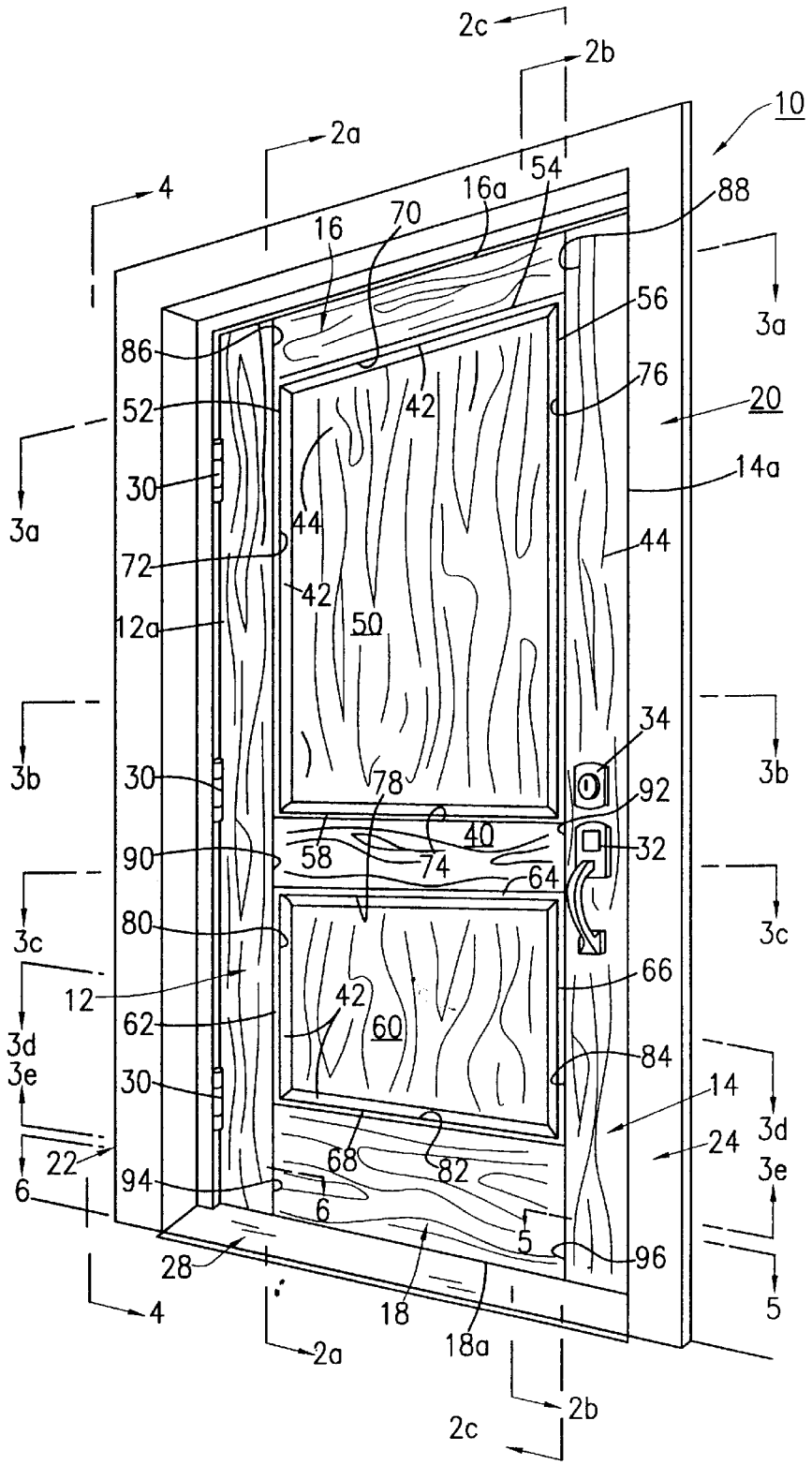
FIG. 1 is a front perspective view of the fire retardant wooden door of the preferred embodiment of the present invention showing its major component parts thereof.
Figure 2A:
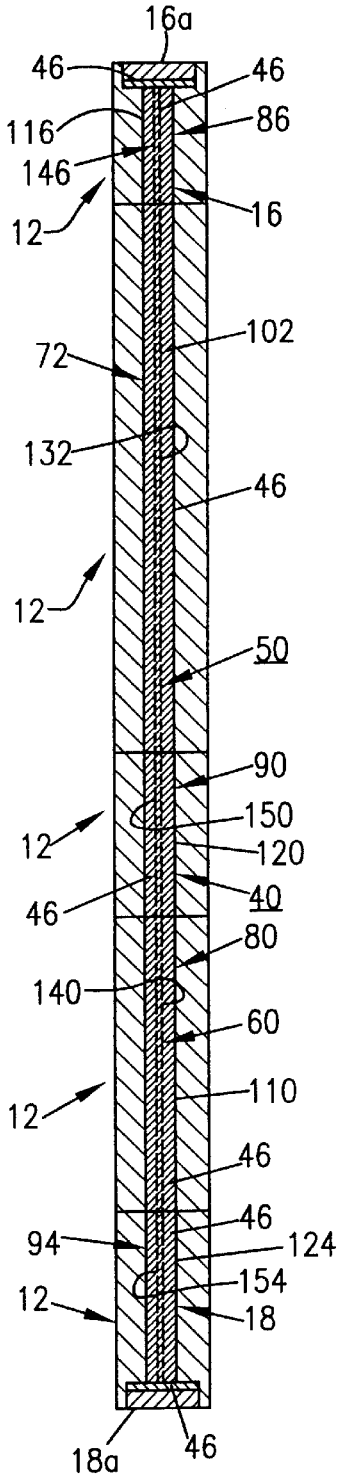
FIG. 2*a* is a cross-sectional view of a fire retardant wooden door of the present invention taken along lines 2*a*—2*a* of FIG. 1 in the direction of the arrows showing a plurality of tongue and groove joints with intumescent material therein connecting a stile to an upper rail, a center panel and a lower rail.
Figure 2B:
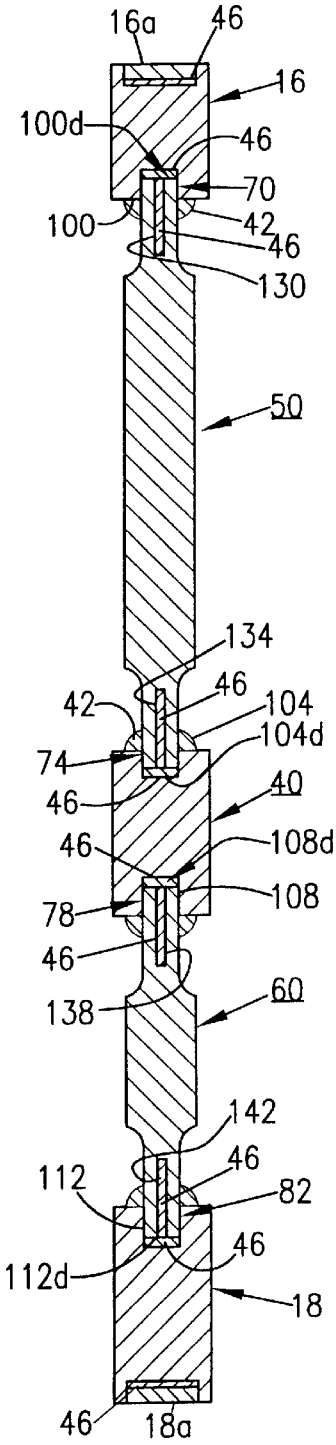
FIG. 2*b* is a cross-sectional view of the fire retardant wooden door of the present invention taken along lines 2*b*—2*b* of FIG. 1 in the direction of the arrows showing a plurality of tongue and groove joints with intumescent material therein connecting an upper panel to the upper rail, a lower panel to the lower rail, and a center panel to the upper and lower panels.
Figure 2C:
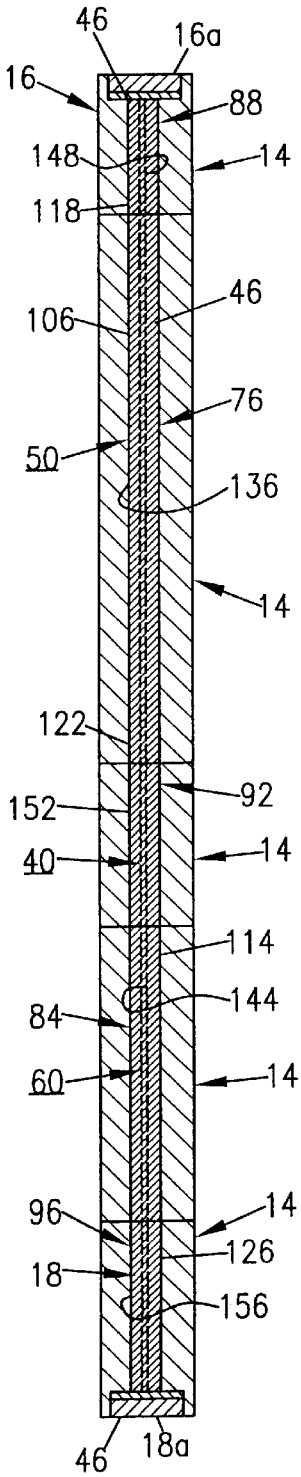
FIG. 2*c* is a cross-sectional view of the fire retardant wooden door of the present invention taken along lines of 2*c*—2*c* of FIG. 1 in the direction of the arrows showing a plurality of tongue and groove joints with a intumescent material therein connecting to a stile to an upper rail, a center panel and a lower rail.
Figure 3A:
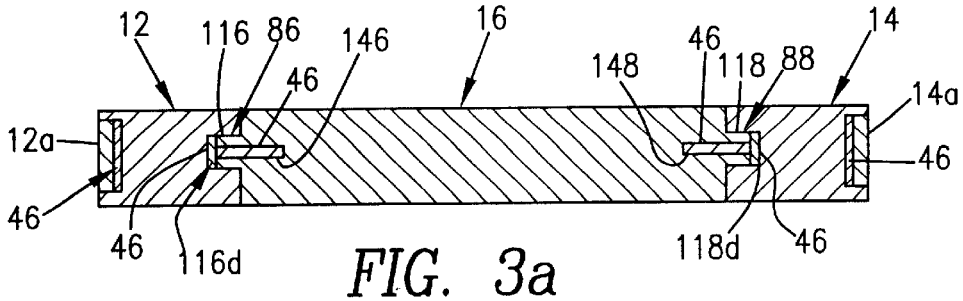
FIG. 3*a* is a cross-sectional view of the fire retardant wooden door of the present invention taken along line 3*a*—3*a* of FIG. 1 in the direction of the arrows showing a pair of tongue and groove joints with intumescent material therein connecting the upper rail to the opposing stiles and to the upper panel.
Figure 3B:
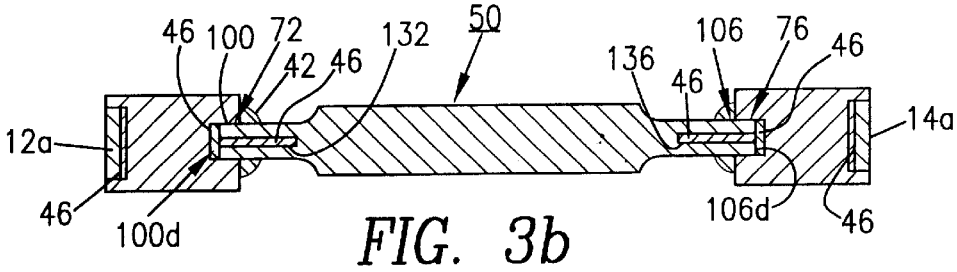
FIG. 3*b* is a cross-sectional view of the fire retardant wooden door of the present invention taken along lines 3*b*—3*b* of FIG. 1 in the direction of the arrows showing a pair of tongue and groove joints with intumescent material being connected to opposing stiles and the upper panel.
Figure 3C:
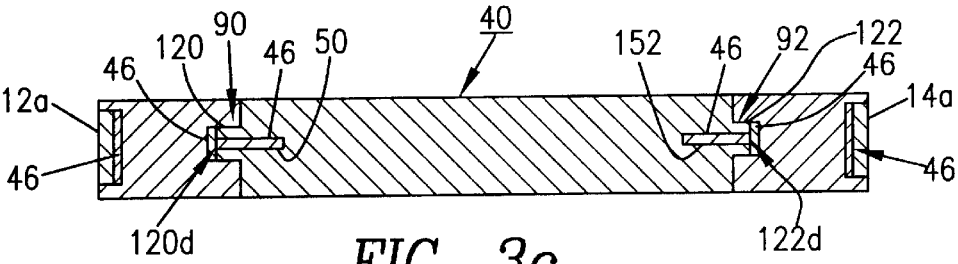
FIG. 3*c* is a cross-sectional view of the fire retardant wooden door of the present invention taken along lines 3*c*—3*c* of FIG. 1 in the direction of the arrows showing a pair of tongue and groove joints with intumescent material being connected to opposing stiles and the center panel.
Figure 3D:
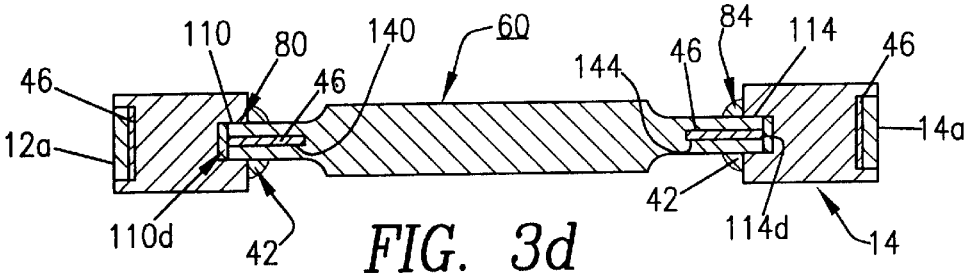
FIG. 3*d* is a cross-sectional view of the fire retardant wooden door of the present invention taken along lines 3*d*—3*d* of FIG. 1 in the direction of the arrows showing a pair of tongue and groove joints with intumescent material being connected to opposing stiles and lower panel.
Figure 3E:
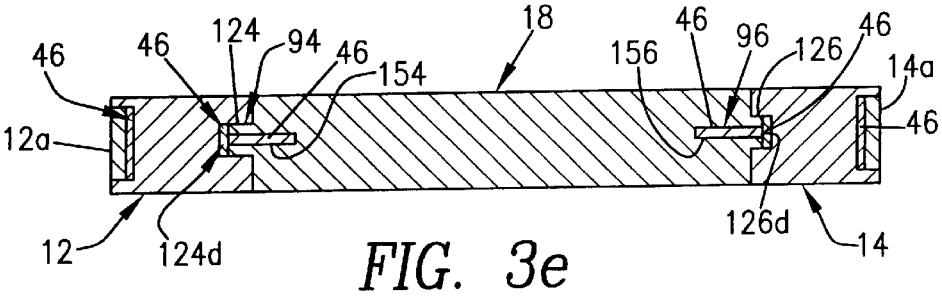
FIG. 3*e* is a cross-sectional view of the fire retardant wooden door of the present invention taken along lines 3*e*—3*e* of FIG. 1 in the direction of the arrows showing a pair of tongue and groove joints with intumescent material therein connecting the lower rail to the opposing stiles and to the lower panel.
Figure 4:
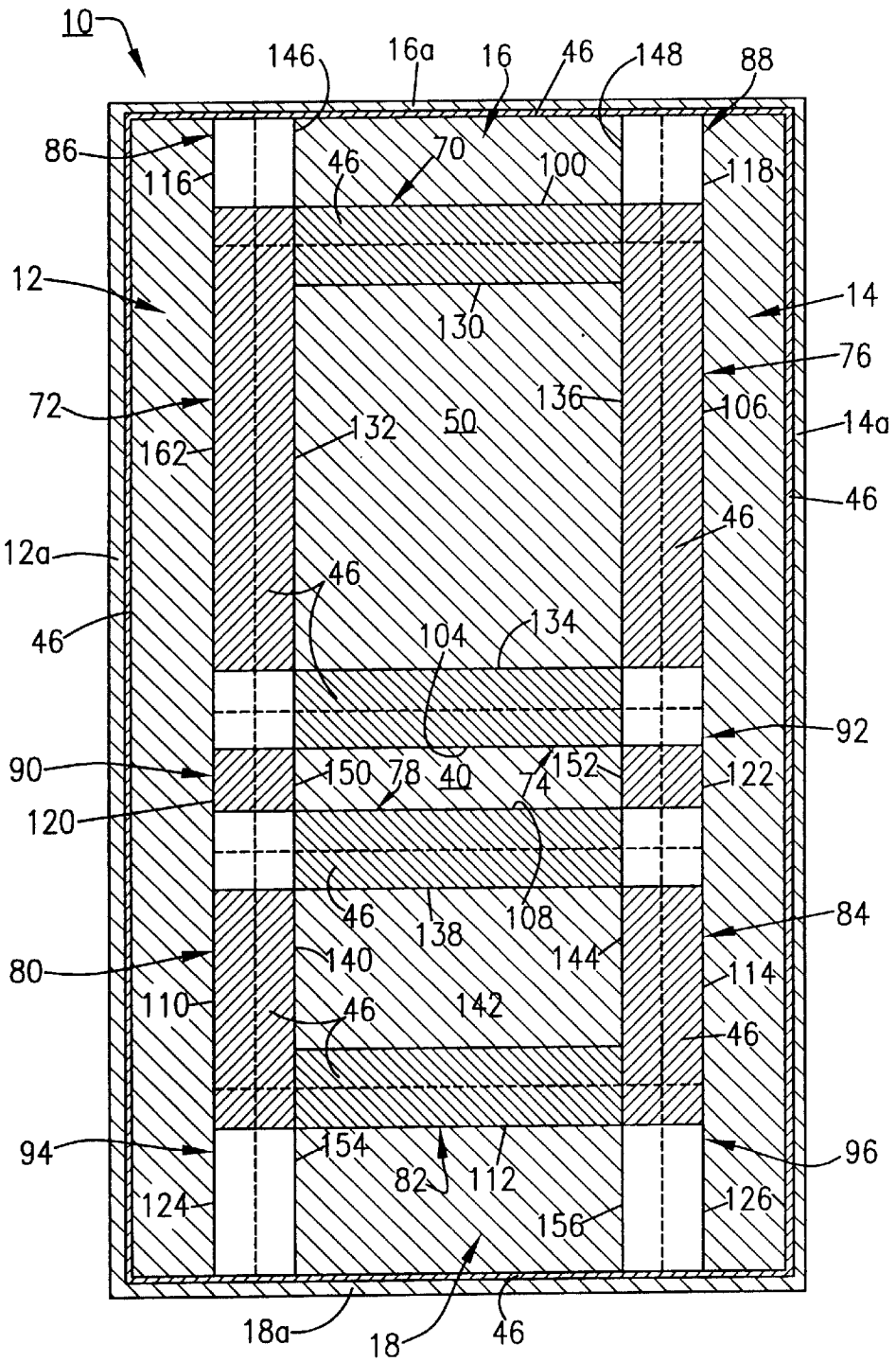
FIG. 4 is a cross-sectional view of the fire retardant wooden door of the present invention taken along lines 4—4 of FIG. 1 in the direction of the arrows showing the intumescent material within the plurality of tongue and groove joints.
Figure 5:
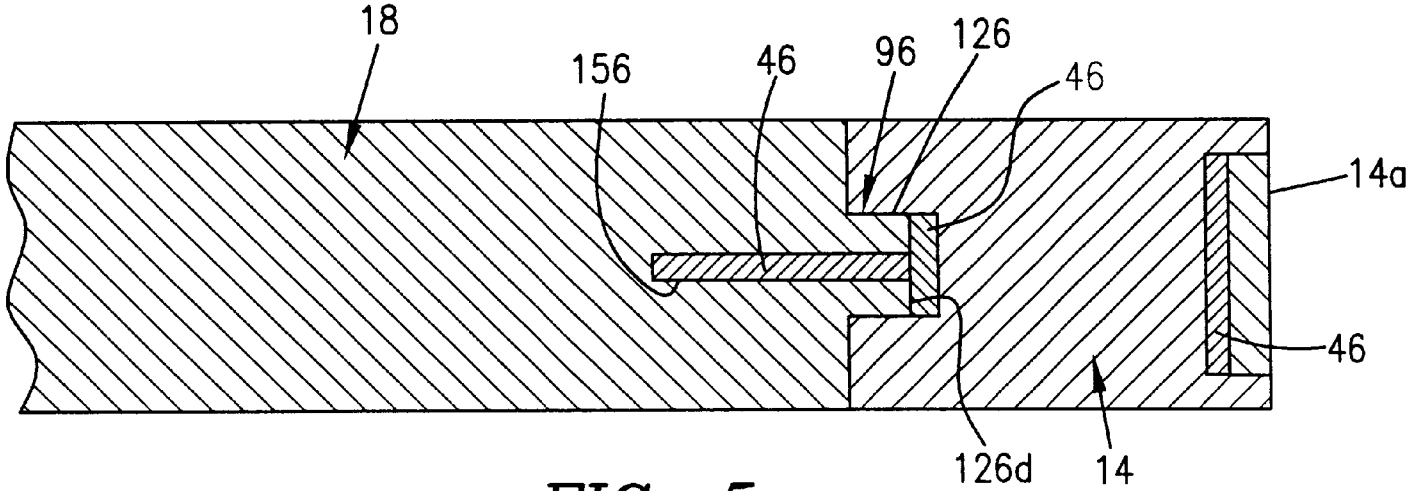
FIG. 5 is an enlarged sectional view of the fire retardant wooden door of the present invention taken along lines 5—5 of FIG. 1 in the direction of the arrows showing the intumescent material embedded within the tongue and groove joint and within the tongue section thereof.
Figure 6:
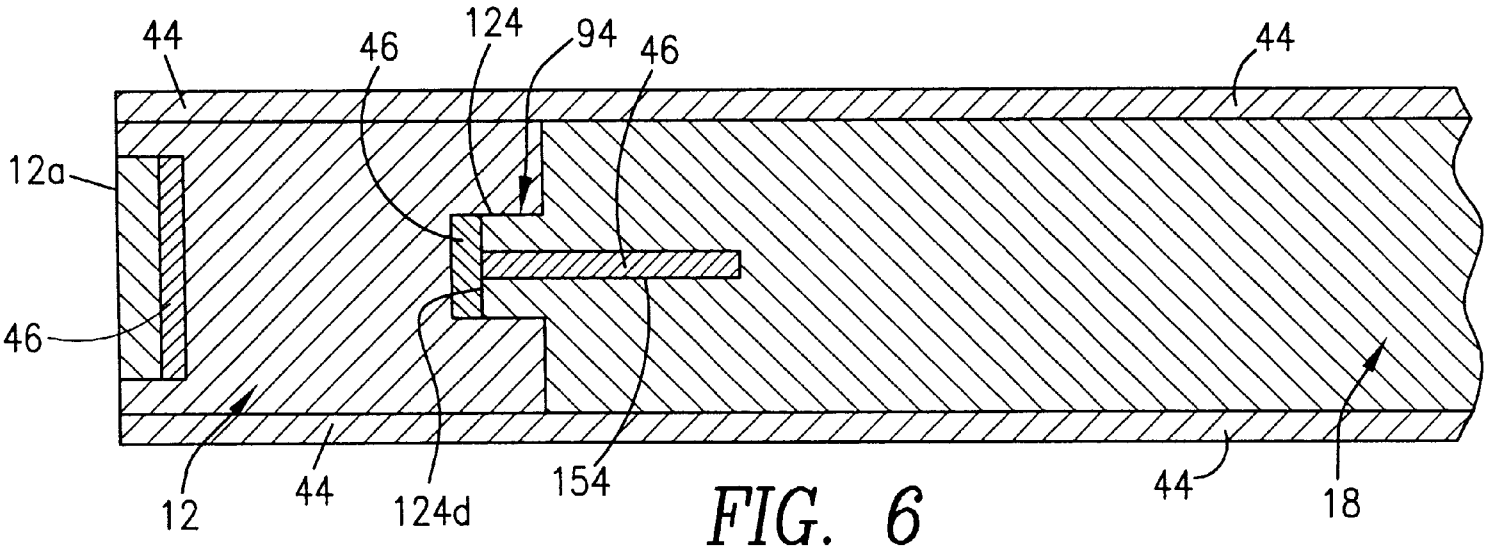
FIG. 6 is an enlarged sectional view of the fire retardant wooden door of the present invention taken along lines 6—6 of FIG. 1 in the direction of the arrows showing the intumescent material embedded within the tongue and groove joint and within the tongue section thereof.

As shown in FIG. 1, the fire retardant wooden door 10 includes stiles 12 and 14, rails 16 and 18 and is hingedly connected within a door frame 20. The door frame 20 includes a left side doorjamb 22, a right side doorjamb 24, an upper header 26 and a lower sill 28. Suitable hinges 30 are used to mount the door 10 to the hinge jamb 22 in a manner which allows the door 10 to be opened or closed. A handle 32 is provided to operate a latch 34 which retains the door in the closed position.

The fire retardant wooden door 10 further includes a center panel 40, an upper panel 50 and a lower panel 60. Panel 50 has edges 52, 54, 56 and 58, and panel 60 has edges 62, 64, 66, and 68. Stiles 12, 14, rails 16, 18 and panels 40, 50 and 60 are all made of solid wood, such as oak, maple, walnut, teak and the like. Wood molding strips 42 are applied to the exterior surface of the panels 50 and 60 as shown in FIGS. 1, 2*a*, 2*b*, 3*a* and 3*b* of the drawings. Alternatively, stiles 12 and 14 are made of composite flake board, plywood, pressed board and the like, wherein then the stiles 12, 14 and panels 40, 50 and 60 are of a laminated construction that includes a wood veneer 44 applied to outer surfaces of the stiles and panels of door 10. Additionally, panels 50 and 60 can have a thickness that is approximately the same as that of the stiles 12 and 14 and rails 16 and 18, or panels 50 and 60 can have a thickness that is less than that of the stiles 12 and 14 and rails 16 and 18. Also, panels 50 and 60 can have a thickness that is more than that of the stiles 12 and 14 and rails 16 and 18.

Tongue and groove joints 70 and 72 are used to connect panel 50 to the door 10, and tongue and groove joints 74 and 76 are used to connect panel 50 to the door 10. Tongue and groove joints 78 and 80 are used to connect panel 60 to the door 10, and tongue and groove joints 82 and 84 are used to connect panel 60 to the door 10. Additionally, tongue and groove joints 86 and 88 are used to connect the upper rail 16 to stiles 12 and 14. Tongue and groove joints 90 and 92 are used to connect the center panel 40 to stiles 12 and 15. Tongue and groove joints 94 and 96 are used to connect the lower rail 18 to stiles 12 and 14. Each of the tongue and groove joints 70, 72, 74, 76, 78, 80, 82, 84, 86, 88, 90, 92, 94 and 96 includes a respective tongue section 1001, 102, 104, 106, 108, 110, 112, 114, 116, 118, 120, 122, 124, and 126 having a distal edge 100*d*, 0120*d*, 10*d*, 106*d*, 108*d*, 110*d*, 112*d*, 114*d*, 116*d*, 118*d*, 120*d*, 122*d*, 124*d* and 126*d* at the end thereof. The tongue and groove joints 70 to 84 are made to be fire resistant by using an intumescent material 46 being applied to each of the distal edges (contact surfaces) 100*d* to 126*d* of each tongue section 90 to 126, respectively, as depicted in FIGS. 2*a*, 2*b*, 3*a*, 3*b* and 4 of the drawings. Further, each of the tongue sections 100 to 126 of tongue and groove joints 70 to 84 include milled interior channels 130, 132, 134, 136, 138, 140, 142, 144, 146, 148, 150, 152, 154 and 156, being centrally positioned and formed along the axis of each tongue section 90 to 126 Each of the milled interior channels 130 to 156 extends into respective panels 40, 50 and 60 a distance of at least two (2) inches, as shown in FIGS. 2*a*, 2*b*, 3*a*, 3*b* and 4. Each of the milled interior channels 130 to 156 has intumescent material 46 embedded therein for providing increased fire resistance to door 10. Intumescent material 46 is also applied to outer perimeter edges 12*a*, 14*a*, 16*a* and 18*a* of the stiles 12, 14 and the rails 16, 18, respectively, as shown in FIGS. 1 to 4 of the drawings. The intumescent material 46 expands in the presence of excessive heat or fire such that the intumescent material 46 closes and seals each of the tongue and groove contact surfaces 100*d* to 126*d* of the tongue and groove joints 70 to 94, as well as the intumescent material 46 closes and seals each of the interior channels 130 to 156 within each of the tongue sections 100 to 126 of tongue and groove joints 70 to 94 to prevent the spread of the excessive heat or fire through the fire retardant door 10. Additionally, the intumescent material 46 on the outer perimeter edges 12*a*, 14*a*, 16*a* and 18*a* of the stiles and rails 12, 14, 16, 18, respectively, also expands in the presence of excessive heat or fire such that the intumescent material 46 closes and seals the perimeter of the fire retardant door 10 within the jambs 22, 24 and headers 26, 28 of the door frame 20 to also prevent the spread of the excessive heat or fire through the fire retardant door 10 and door frame 20.

Alternate Embodiment 200

Figure 7:
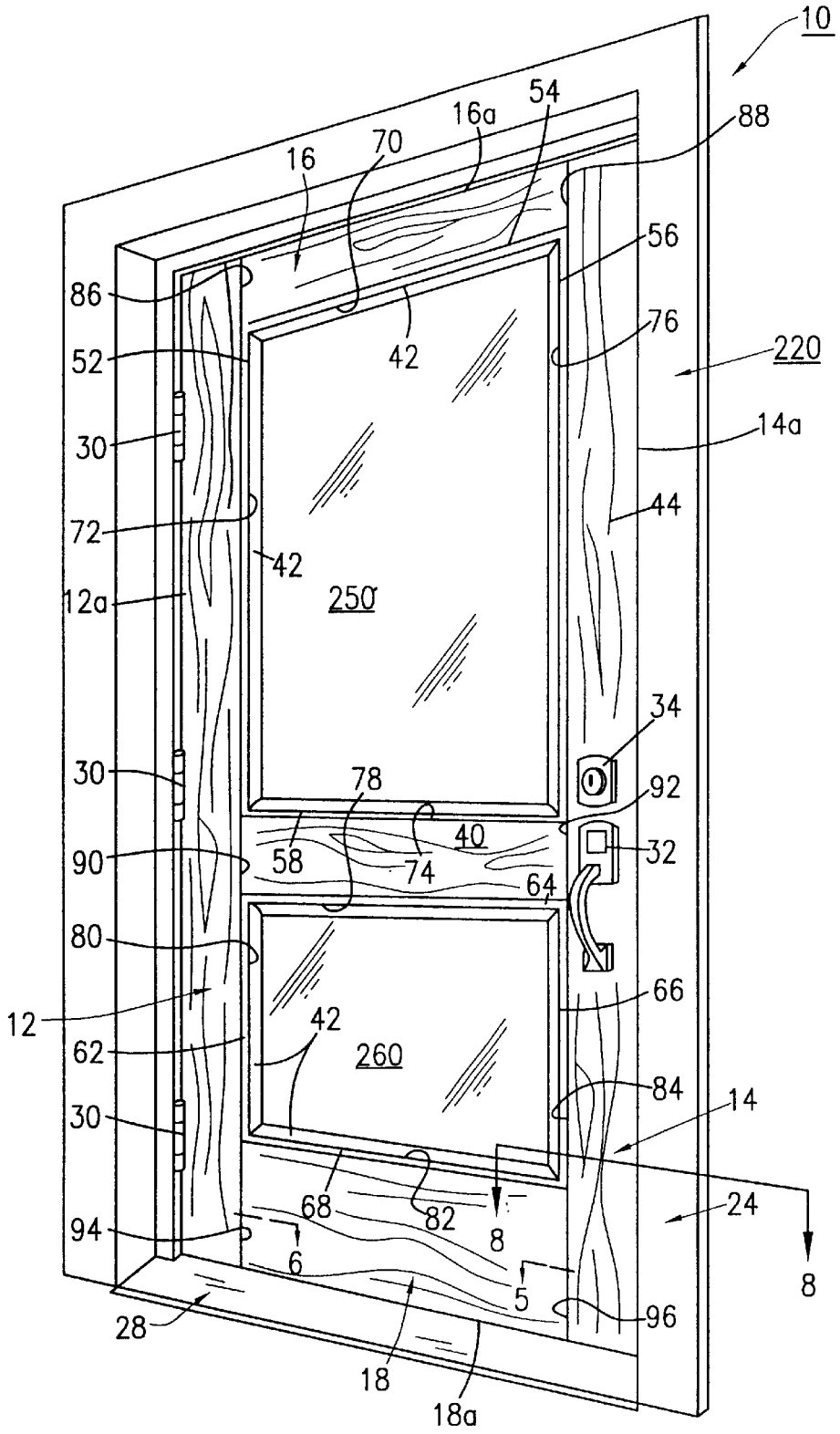
FIG. 7 is a front perspective view of the fire retardant wooden door of the alternate embodiment of the present invention showing its major component parts thereof.
Figure 8:
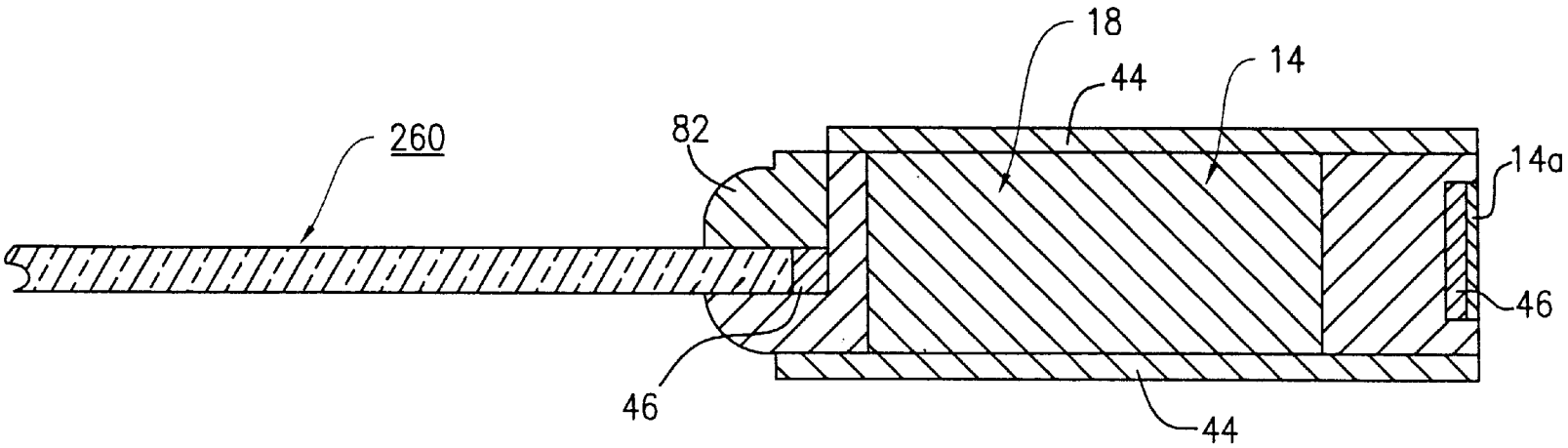
FIG. 8 is an enlarged sectional view of the fire retardant wooden door of the present invention taken along lines 8—8 of FIG. 7 in the direction of the arrows showing the intumescent material embedded within the tongue and groove joint and within the tongue section thereof.

The fire retardant wooden door 200 and its component parts of the alternate embodiment of the present invention is represented in detail by FIGS. 7 and 8 of the patent drawings. The fire retardant door 200 is also used to fire proof an area and to prevent fire from spreading to other areas within a home dwelling, commercial building or industrial plant. All aspects of the second embodiment of the fire retardant wood door 200 are exactly the same except for the use of fire-tempered glass panels 250 and 260 within an alternate door frame 220 which replace the wood panels 50 and 60 of the fire retardant wooden door 10 of the preferred embodiment.

In all other aspects, all of the component parts are exactly the same as the preferred embodiment of the fire retardant wood door 10 except for using of the fire tempered glass panels 250 and 260 within the door frame 220, as shown in FIGS. 7 and 8.

Operation of the Present Invention

In operation, when fire or excessive heat occurs, the intumescent material 46 expands and provides closing and sealing of all the tongue and groove joints 70 to 94. This includes closing and sealing of the distal edges 100*d* to 126*d* and of the interior channels 130 to 156 within each of the tongue sections 100 to 126 of tongue and groove joints 70 to 94, and also provides closing and sealing of the perimeter edges 12*a* to 18*a* of the fire retardant wooden door 10 within its door frame 20, thus preventing the spread of the fire through the fire retardant wooden door 10 and door frame 20. In particular, the interior channels 130 to 156 expand to seal the length of the tongue sections 100 to 126 relative to their respective grooves.

The fire retardant wooden door 10 of this invention has undergone special testing by I.T.S. Warnock Hersey Laboratory for fire resistance and has passed the fire bum test known as ANSI/U.L. 10B1978 including the hose stream test. By passing this fire burn test, the door 10 can be specified by architects for many building uses where metal doors and wood flush doors would have been previously used.

The I.T.S. test under ANSI/U.L. 10B1978 includes the following steps:

1. The door structure to be tested is placed within a brick retaining wall.
2. One side of the door is subjected to an intense fire on a time temperature curve from 0 to 20 minutes and 0 to 1,462° F. temperature. More specifically, the time-temperature is as follows:
   Start: Room temperature
   5 minutes: 1000° F.
   10 minutes: 1300° F.
   20 minutes: 1462° F.
3. Immediately after the 20 minute burn period, the burned side of the door is subjected to a hose stream test from: a) a 2½ inch water supply hose; b) discharged through a tapered nozzle with a one (1) inch outlet opening; c) regulated to a 30 PSI discharge pressure; d) applied a distance of 20 feet from the door structure; and e) the time period of application of the water stream against the middle and all exposed parts of the door structure is controlled.

The door being tested passes this testing procedure if no door panel members are disengaged from the supporting door frame assembly and if no openings are created.

In summary, the fire retardant wooden door 10 of the present invention has passed a twenty (20) minute burn test performed by a I.T.S. testing laboratory to obtain and meet the fire resistant specification known as the ANSI/U.L. 10B fire burn test for doors.

Advantages of the Present Invention

Accordingly, it is an advantage of the present invention that it provides for a fire retardant wooden door that prevents the spread of fire through the door and door frame for at least 20 minutes.

Another advantage of the present invention is that it provides for a fire retardant wooden door that has fire resistant material strategically embedded and placed within the tongue and groove joints of the fire resistant door, as well as supplemental fire resistant material placed on the perimeter edges of the fire resistant door for preventing the spread of fire through the door and door frame.

Another advantage of the present invention is that it provides for a fire retardant wooden door that has fire resistant material being intumescent material that expands in the presence of fire such that the intumescent material closes and seals the component tongue and groove joints, as well as the perimeter edges of the fire retardant door for preventing the spread of fire through the door and door frame.

Another advantage of the present invention is that it provides for a fire retardant wooden door that is used as part of an interior or exterior personal living space or workspace, and being installed within home dwellings, commercial buildings or industrial plants.

Another advantage of the present invention is that it provides for a fire retardant wooden door that is aesthetically pleasing having the appearance of natural wood, and has achieved a successful fire rating of at least 20 minutes, and is easily installed in a building.

A further advantage of the present invention is that it provides for a fire retardant wooden door that can be mass produced in an automated and economical matter and is readily affordable to the builder or consumer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A fire retardant wooden door, comprising:

a) a door having at least one door panel or glass panel ¼" fire rated and stiles and rails;

b) said at least one door panel being connected to said stiles and rails by tongue and groove joints, and said tongue and groove joints having intumescent material therein;

c) each of said tongue and groove joints includes a tongue section having said intumescent material along a distal edge of said tongue section which expands upon exposure to heat or fire to seal said tongue and groove joints in order to prevent the heat or fire from passing through said door during a fire;

d) each of said tongue sections includes an interior channel extending along the axis of said tongue section, and said interior channel extending into said at least one door panel; and e) said interior channel having said intumescent material embedded therein which expands upon exposure to heat or fire to further seal said tongue and groove joints in order to prevent the heat or fire from passing through said door during a fire.

2. A fire retardant wooden door in accordance with claim 1, wherein said door includes perimeter edging having said intumescent material thereon which expands upon exposure to heat or fire to seal said perimeter edging relative to a door frame in order to prevent the heat or fire from passing through said door and door frame during a fire.

3. A fire retardant wooden door in accordance with claim 2, wherein said door is constructed to pass a twenty (20) minute burn test performed by a testing laboratory to obtain a fire resistant specification known as the ANSI/U.L. 10B fire burn test.

4. A fire retardant wooden door in accordance with claim 3, wherein said wooden door is made of wood material selected from the group consisting of oak, maple, walnut, teak, other hardwoods and composite board.

5. A fire retardant wooden door in accordance with claim 4, wherein said stiles and said at least one door panel are of a laminated construction and include a wood veneer applied to the surfaces of said stiles, said rails and said door panel.

6. A fire retardant wood door in accordance with claim 4, wherein said stiles are of laminated construction and include a wood veneer applied to the surfaces of said stiles.

7. A fire retardant wood door in accordance with claim 1, wherein said at least one door panel is made of fire-tempered glass.

8. A fire retardant wooden door in accordance with claim 5, wherein said at least one door panel has a thickness which is approximately the same as that of said stiles and rails.

9. A fire retardant wooden door in accordance with claim 5, wherein said at least one door panel has a thickness less than that of said stiles and rails.

10. A fire retardant wooden door in accordance with claim 9, wherein said at least one panel has a thickness more than that of said stiles and rails.

11. A fire retardant wooden door in accordance with claim 1, wherein said interior channel of said tongue section extends into said at least one door panel a distance of at least two (2) inches.

12. A fire retardant wooden door in accordance with claim 1, wherein said intumescent material extends into said tongue section at least two (2) inches.

13. A fire retardant wooden door, comprising:

a) a door having at least two door panels or glass panels ¼" fire rated and stiles and rails;

b) said at least two door panels being connected to said stiles and rails by tongue and groove joints, and said tongue and groove joints having intumescent material therein;

c) each of said tongue and groove joints includes a tongue section having said intumescent material along a distal edge of said tongue section which expands upon exposure to heat or fire to seal said tongue and groove joints in order to prevent the heat or fire from passing through said door during a fire;

d) each of said tongue sections includes an interior channel extending along the axis of said tongue section, and said interior channel extending into said at least two door panels; and e) said interior channel having said intumescent material embedded therein which expands upon exposure to heat or fire to further seal said tongue and groove joints in order to prevent the heat or fire from passing through said door during a fire.

14. A fire retardant wooden door in accordance with claim 13, wherein said door includes perimeter edging having said intumescent material thereon which expands upon exposure to heat or fire to seal said perimeter edging relative to a door frame in order to prevent the heat or fire from passing through said door and door frame during a fire.

15. A fire retardant wooden door in accordance with claim 14, wherein said door is constructed to pass a twenty (20) minute burn test performed by a testing laboratory to obtain a fire resistant specification known as the ANSI/U.L. 10B fire burn test.

16. A fire retardant wooden door in accordance with claim 15, wherein said wooden door is made of wood material selected from the group consisting of oak, maple, walnut, teak, other hardwoods and composite board.

17. A fire retardant wooden door in accordance with claim 16, wherein said stiles said rails and said at least two door panels are of a laminated construction and include a wood veneer applied to the surfaces of said stiles, said rails and said panels.

18. A fire retardant wood door in accordance with claim 16, wherein said stiles are of laminated construction and include a wood veneer applied to the surfaces of said stiles.

19. A fire retardant wood door in accordance with claim 13, wherein said at least two door panels are made of fire-tempered glass.

20. A fire retardant wooden door in accordance with claim 17, wherein said at least two door panels have a thickness which is approximately the same as that of said stiles and rails.

21. A fire retardant wooden door in accordance with claim 17, wherein said at least two door panels have a thickness less than that of said stiles and rails.

22. A fire retardant wooden door in accordance with claim 17, wherein said at least two door panels have a thickness more than that of said stiles and rails.

23. A fire retardant wooden door in accordance with claim 13, wherein said interior channel of said tongue section extends into each of said at least two door panels a distance of at least two (2) inches.

24. A fire retardant wooden door in accordance with claim 13, wherein said intumescent material extends into said tongue section at least two (2) inches.

* * * * *